US005185961A

United States Patent [19]

Maier

[11] Patent Number: 5,185,961

[45] Date of Patent: Feb. 16, 1993

[54] METHOD AND APPARATUS FOR COPY-GRINDING AND FINISHING OR CYLINDRICAL AND SPHERICAL SURFACES

[75] Inventor: Urs Maier, Winterthur, Switzerland

[73] Assignee: Farros Blatter AG, Winterthur, Switzerland

[21] Appl. No.: 684,980

[22] Filed: Apr. 15, 1991

Related U.S. Application Data

[62] Division of Ser. No. 407,295, Sep. 14, 1989, abandoned.

[30] Foreign Application Priority Data

Sep. 14, 1988 [DE] Fed. Rep. of Germany ..... 3831294

[51] Int. Cl.[5] ..... B24B 5/00

[52] U.S. Cl. ..... 54/145 R; 51/137; 51/165.77; 51/148

[58] Field of Search ..... 51/145 R, 155, 137, 51/147, 34 C, 35, 165.77, 251, 289 R, 148

[56] References Cited

U.S. PATENT DOCUMENTS

| | | | |
|---|---|---|---|
| 1,758,100 | 5/1930 | Andrews | 51/34 C |
| 2,162,044 | 6/1939 | Wilson | 51/165.77 X |
| 3,165,865 | 1/1965 | Bousquet et al. . | |
| 4,201,016 | 5/1980 | Kirk | 51/165.77 X |
| 4,488,382 | 12/1984 | Zajac et al. | 51/145 R X |
| 4,841,683 | 6/1989 | Williams | 51/142 |

FOREIGN PATENT DOCUMENTS

| | | |
|---|---|---|
| 560078 | 9/1932 | Fed. Rep. of Germany . |
| 363926 | 8/1987 | Fed. Rep. of Germany . |
| 3616260 | 8/1987 | Fed. Rep. of Germany . |
| 2185918 | 8/1987 | United Kingdom . |

*Primary Examiner*—M. Rachuba

*Attorney, Agent, or Firm*—Burns, Doane, Swecker & Mathis

[57] ABSTRACT

A process that includes a precision grinding and subsequent finish grinding is preceded by an initial grinding phase in which a grinding belt that is pressed with predetermined pressure onto the outer surface of a preheated cylinder to be processed within a clearance X and X'. The clearance is adjustable by an adjusting device that adjusts the clearance between a profile plate and a contact roll in a manner such that a coating on the cylinder surface is uniformly removed independently of the surface geometry. Following the initial grinding, the pressure applied by the grinding belt is varied in a first grinding phase until a fixed connection between the profile plate and the contact roll is established. Such a method assures the uniform distribution of heat and thus the uniform expansion of the cylinder surface. Consequently, the cylinder can be machined with greater accuracy.

7 Claims, 4 Drawing Sheets

METHOD AND APPARATUS FOR COPY-GRINDING AND FINISHING OR CYLINDRICAL AND SPHERICAL SURFACES

This application is a divisional, of application Ser. No. 07/407,295, filed Sep. 14, 1989 now abandoned.

FIELD OF THE INVENTION

The invention concerns a process and an apparatus for copy-grinding and finishing of cylindrical and spherical surfaces.

BACKGROUND OF THE INVENTION

In current disk grinding apparati, a cylindrical surface included for grinding is rolled over a grinding disk that is controlled by a cam plate. However, due to the grinding disk resting with its edge on the cylindrical surface, the formation of ridges on the surface to be processed cannot be avoided. In fact, in a worst case situation, turning of the surface may be required, followed by equalizing and finish grinding which, in most cases, involves several time consuming working steps. In addition, the turning and subsequent grinding operations contribute to the wear of the cylinder, thus reducing the overall life of the cylinder to be processed. These subsequent operations are particularly difficult and expensive at the ends of the cylinder which have slightly convex edges and require special devices to achieve acceptable results.

It is further necessary to preheat the turning and grinding machines over long periods of time since the machines are not protected against the radiating heat of the heat cylinder.

An apparatus of this type is known from DE-OS 36 39 264. Here, between two brackets mounted on columns, a support and an adjustable profile plate acting as a guideway and having a form corresponding to the set value of the spherical surface accuracy are provided. On the profile plate and the support, a grinding belt device that includes a grinding belt drive, a feed slide with adjusting devices and axially displaceable guide bushings and a clamping device are located.

A disadvantage which generally prevails in the grinding of worn uneven cylindrical surfaces is that, after an initial grinding phase, the cylindrical surface has both machined and unmachined spaces that have different radiating conditions. The machined surfaces give off less heat than the unmachined surfaces so that different temperatures are present in the cylinder wall. This results in uneven thermal expansions on the surface to be ground which, in turn, leads to inaccurate grinding of the cylinder surface.

OBJECTS AND SUMMARY OF THE INVENTION

It is the object of the present invention to prevent such high expansion differences between the machined and unmachined work partial surfaces of the cylinder in order to obtain greater machining precision, reduce the amount of material removal and to shorten grinding times and thereby extend the life of the cylinder.

This object is attained by the present invention as set forth in the claims.

An advantage of the present invention is that the precision grinding and subsequent finish grinding phases of the process are preceded by a grinding phase wherein the grinding belt is pressed with a predetermined pressure against the outer surface of the cylinder within an adjustable clearance. The adjustable clearance is between a profile plate and a contact roll so that the cylindrical surface is processed uniformly regardless of its geometry. The present invention assures a uniform heat distribution and thus a uniform expansion of the cylinder surface which is particularly important in the radial direction. In this manner, a cylinder geometry of a higher accuracy is obtained. In addition, the advantages of shorter grinding times with less material removal are obtained, which increases the life of the machined cylinders and reduces the amount of the grinding belt materials needed.

In the apparatus, the usual infeeds of the grinding belts relative to the cylinder surface are supplemented by a clearance movement X' which is adjustable between the profile plate and the contact roll by an adjusting mechanism wherein, preferably a $X1=X2=X/2$ setting is established.

The support is shielded with a special heat plate relative to the cylinder surface to be machined such that deformations of the support are prevented and a higher processing precision of the cylinder to be machined can be obtained. Also, the time previously required for preheating of the grinding apparatus is eliminated.

BRIEF DESCRIPTION OF THE DRAWINGS

These objects are accomplished in accordance with a preferred embodiment which is illustrated in the accompanying drawings wherein the numbers refer to like items, and in which.

Figure 1:
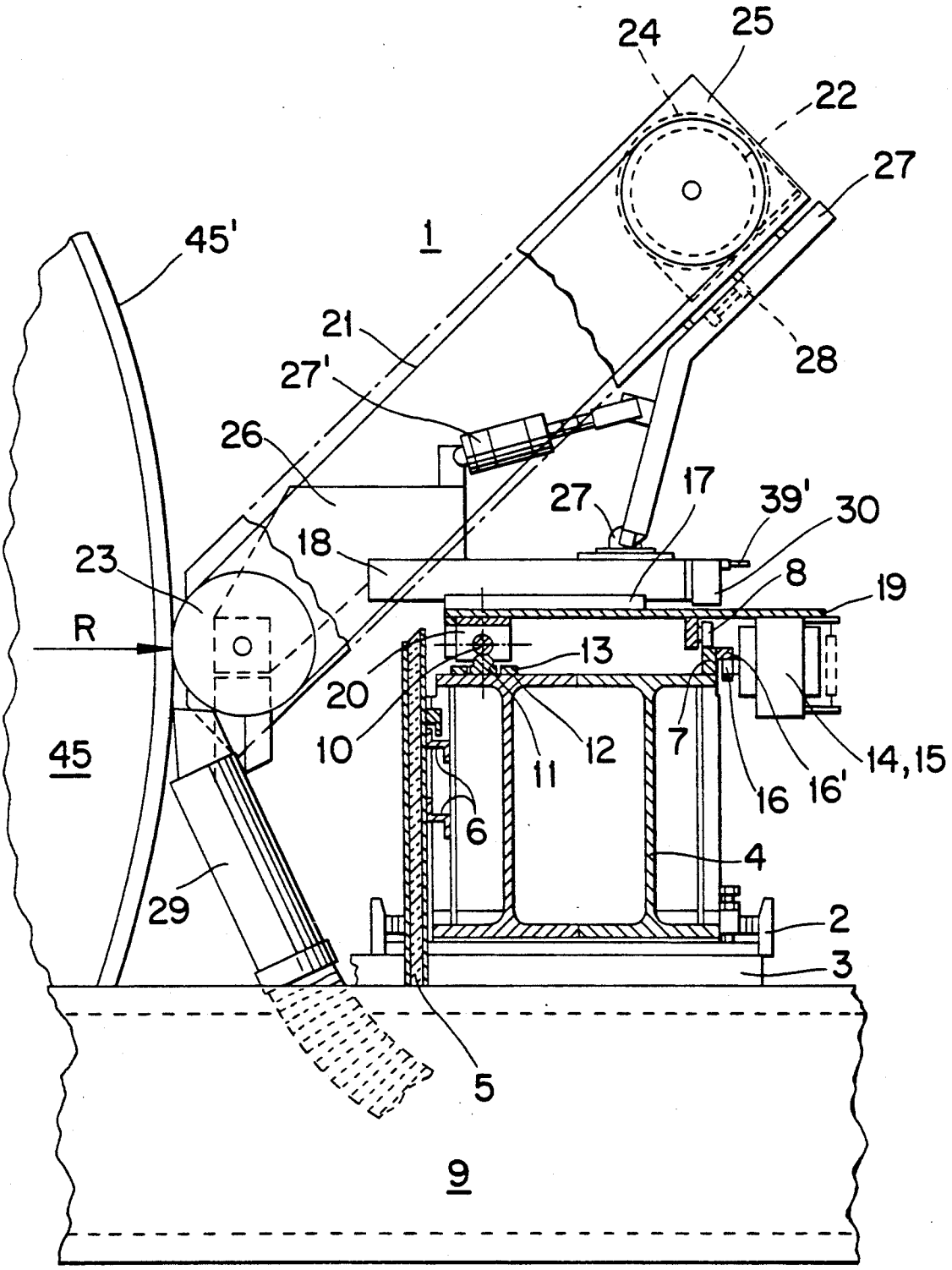
FIG. 1 is a view of the apparatus according to a preferred embodiment of the invention.
Figure 2:
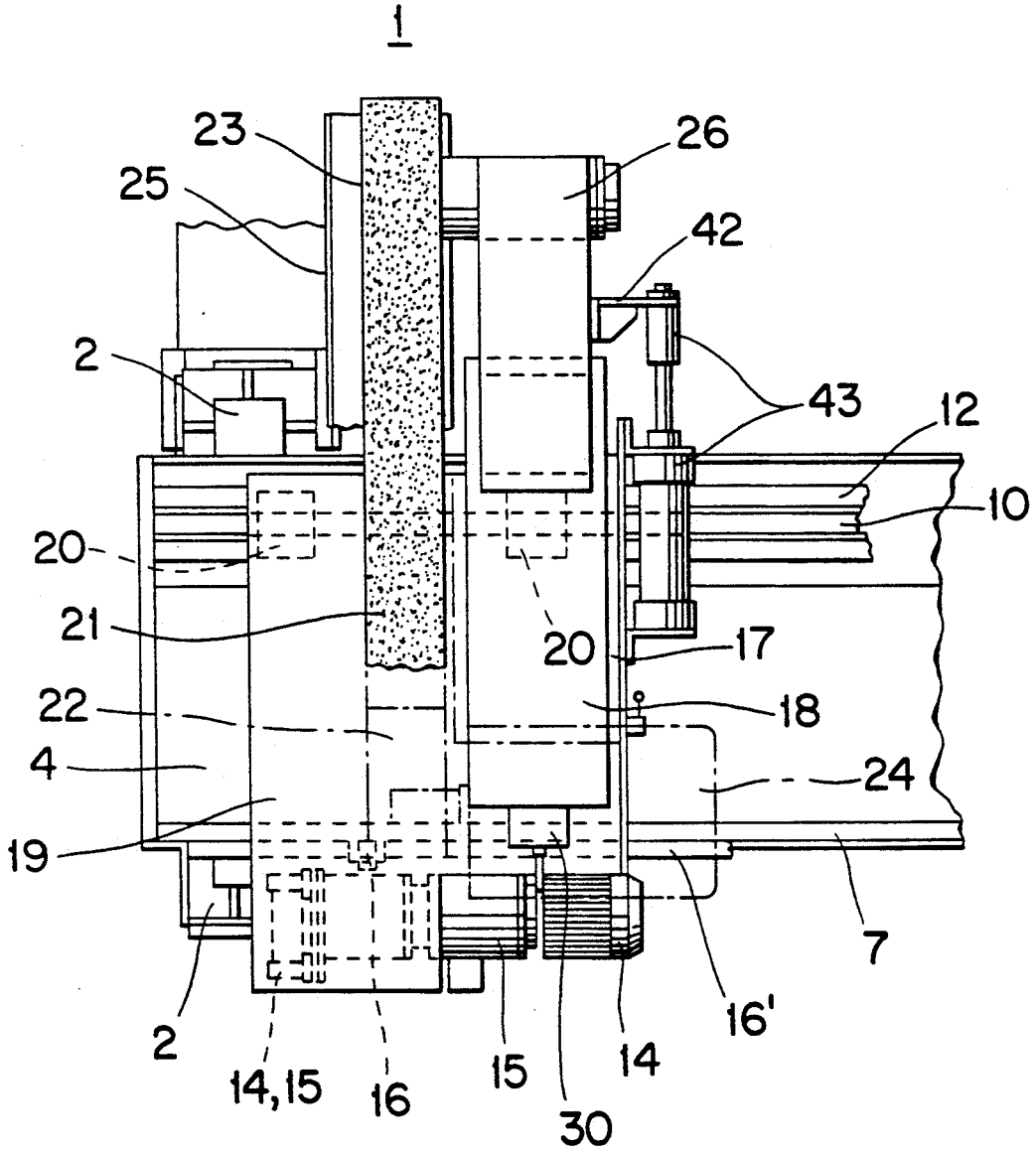
FIG. 2 is a top elevation of the apparatus according to FIG. 1.

According to FIGS. 1 and 2, a machine stand 9 is shown on which brackets 2 are provided to secure a support 4 onto a base plate 3. Disposed on the support 4 are a guideway 7 that cooperates with a support rollers 8 and a profile plate 10. Additionally disposed on support 4 is a plurality of stays 11 that, together with seats 12, are adjustably separated from each other by a space. The profile plate 10 is located in the stays 11 (seen in FIG. 2 in cross-section only). On both sides of each seat 12 are adjusting screws 13 (indicated by screw axes only) whereby the position of the profile plate 10 may be adjusted on the support 4 in accordance with predetermined set dimensions. In this connection, see FIG. 3 of German Publication No. 36 39 264. The dimensions are set in relation to the spherical terminal parts of the cylinder such that the profile plate 10 conforms to a desired profile for the surface to be ground 45' over the entire length of the cylinder 45. The support 4 is shielded against the cylinder surface 45' to be ground by a thermal insulating plate 5.

On the guideway 7 is disposed a support plate 19 with a displaceable feed slide 18, the support plate 19 is slidable along the guideway 7 over the support rollers 8 in a direction along the longitudinal axis of the cylinder 45. The support plate 19 carries the mobile guide bushings 20 and the guide bushings 20 are slidable on the profile plate 10. By means of a drive motor 14, a gear 15, a tooth gear 16, and a rack 16', the feed slide 18 is guided along the surface 45' to be ground along the longitudinal axis of the cylinder 45. Mounted on feed slide 18 is a belt grinding device having 14, a drive roll 22 and a contact roll 23 for the grinding belt 21.

Guidance of the belt grinding device by means of the guide bushings 20 on the profile plate 10 assumes that the contact roll 23 is at all times positioned tangentially to the cylinder surface 45 in order to grind a surface without ridges. Through the variable holder 26, the contact roll 23 is linked with the guide bushings 20 so that the surface 45' to be ground is automatically ground in accordance with the given desired profile of profile plate 10.

The tensioning of the grinding belt 21 (equipped with a protective cover 25) is adjusted by means of an adjusting screw 28 and the clamping device 27. The clamping device 27 consists of a clamping cylinder 27' mounted between variable holder 26 and a clamping arm (not numbered). A motor 24 is disposed on one end of the clamping arm. The arm is connected to feedslide 18 at a bearing 27'. The radial feed of the grinding belt contact roll 23 towards the surface 45' is effected by means of the feed slide 18 set by an adjusting device 30.

For the removal of the debris produced due to grinding, an exhaust apparatus 29 consisting of an exhaust nozzle, an intermediate piece and an exhaust hose is provided.

Figure 3:
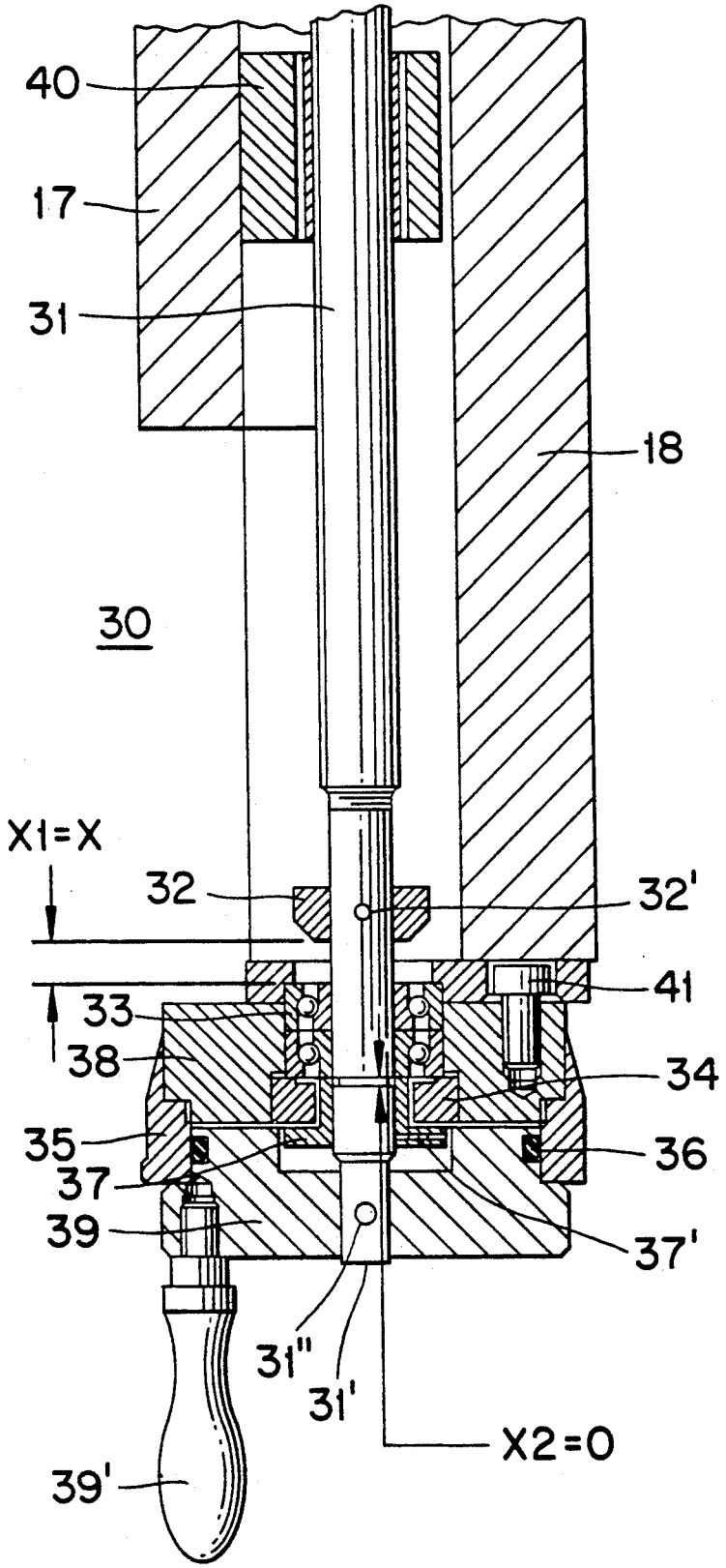
FIG. 3 is a longitudinal cross-section of an adjusting mechanism positioned in a first position and which is located on a feed slide of the apparatus according to FIGS. 1 and 2.
Figure 4:
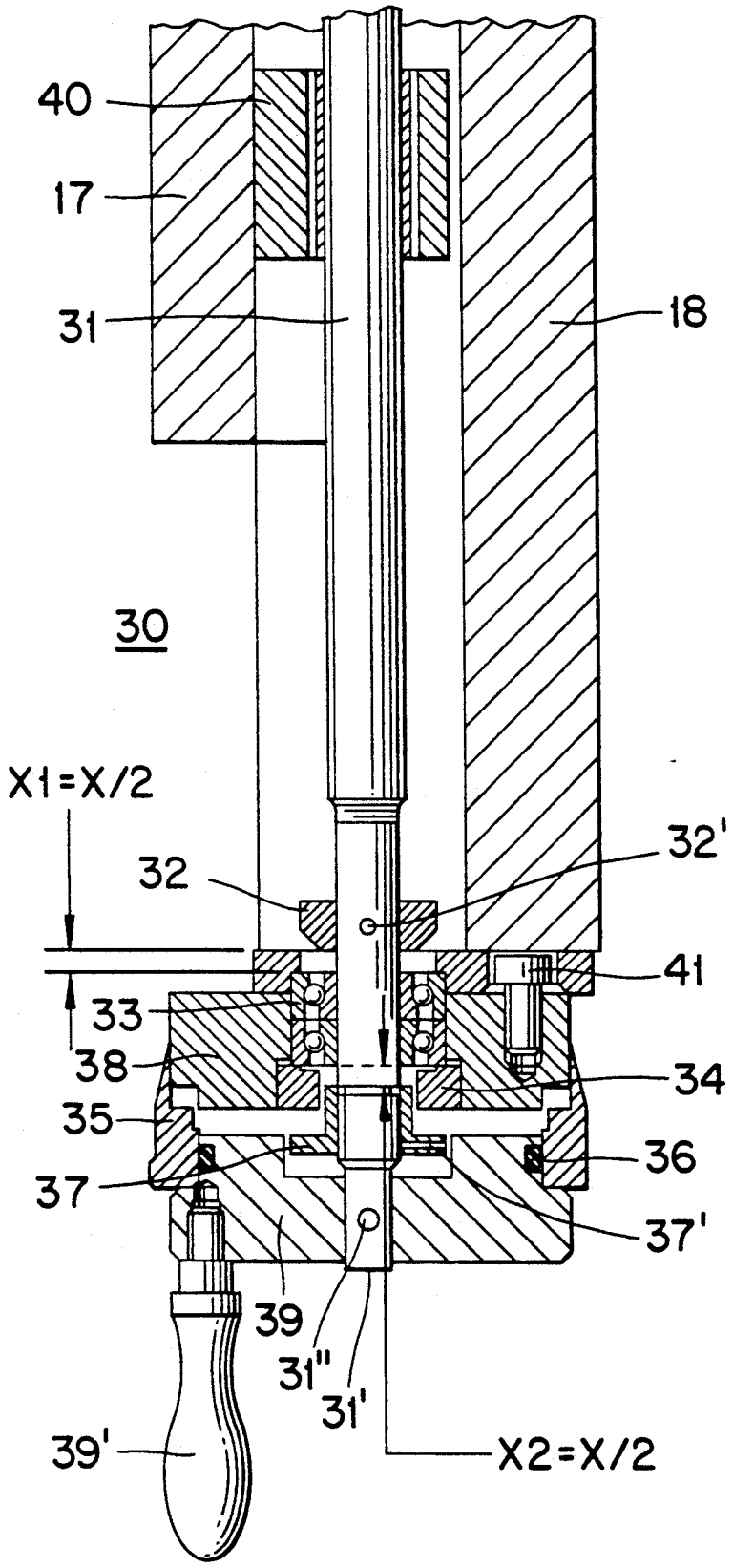
FIG. 4 is a longitudinal cross-section of an adjusting mechanism positioned in a second position and which is located on a feed slide of the apparatus according to FIGS. 1 and 2.

FIG. 3 shows the adjusting device 30 mounted by means of an intermediate piece 38 through a screw 41 on the feed slide 18. A precision spindle 31 equipped with a stop ring 32 is provided wherein the spindle 31 is supported at one end in a threaded spindle guide 40. The spindle guide 40 is disposed on a base plate 17 rigidly connected with the longitudinal carriage 19 and on which the feed carriage 18 is guided in the feed direction. The stop ring 32 is fastened to the spindle 31 by a fastening pin 32'. Spindle end 31', which faces away from the contact roll 23, is supported in bearings 33 which are mounted in intermediate piece 38. The bearings 33 may be tightened by means of a threaded clamp ring 34. The spindle 31 is secured in a sleeve 39 by a fastening pin 31''. To control the linkage between the profile plate 10 and the contact roll 23, a ring 35 is provided. The ring 35 fits over a portion of the intermediate piece 38 of the adjusting device 30 and is entrained through a rubber ring 36 to a sleeve 39 which is equipped with a manual handle 39'. When the sleeve 39 is rotated by moving the manual handle 39', the spindle 31 will turn in the threaded spindle guide 40 thus causing the spindle along with sleeve 39 to translate either towards the surface 45' or away from the surface 45' depending on the direction of rotation. Since the ring 35 is entrained to the sleeve 39, the ring 35 will also translate with the spindle 31. Through adjustment of the sleeve 39, it is possible to accurately set the contact roll 23 relative to the cylinder surface 45'. By overcoming the resistance of the rubber ring, the ring 35 usually may be set to the "zero" position on the scale (not shown) of the intermediate piece 38. An threaded ring 37 constitutes a second stop ring and both threaded ring 37 and stop ring 32 define a clearance X between the profile plate 10 and the contact roll 23. The ring 37 is threaded onto a location on the precision spindle 31 near the threaded clamping ring 34. The threaded ring 37 is angled off toward spindle end 31' and according to the operating conditions it abuts against the bearings 33 as shown in FIG. 3 or is spaced from the bearings 33 as shown in FIG. 4. The threaded ring 37 is secured to the spindle 31 by an adjusting screw 37'.

The threaded ring 37 as positioned as shown in FIG. 3 forms a solid connection between the profile plate 10 and the contact roll 23, the clearance X2 between the ring 37 and the bearings 33 is zero. In order for there to be a clearance between profile plate 10 and the contact roll 23, the spindle 31 is rotated in the spindle guide 40 by turning sleeve 39 such that a clearance is established between the threaded ring 37 and the bearings 33 as shown for example in FIG. 4. When the spindle has moved to the position shown in FIG. 4, a corresponding clearance is provided between the stop ring 32 and the bearings 33. To carry out the clearance movement X of the spindle 31, a pressure mechanism 43 is used. The mechanism 43 is fastened by a holder 42 to the feed slide 18 and to the support plate 19 by another holder (unnumbered). The mechanism 43 may be a pneumatic cylinder or a hydraulic cylinder or compression springs. Preferably, the pressure mechanism sets a clearance setting of $X/2=X1/2$ as shown in FIG. 4.

The mode of operation of the invention is explained in more detail with reference to FIGS. 1 to 4.

The cylinder 45 to be machined, which may have undergone irregular surface wear and may contain surface coatings on the outer surface 45' of various particles such as resin, oil, paint residues or the like, is heated to a predetermined temperature and accelerated to a certain rotating velocity. Following the positioning of the grinding belt mechanism 1 in an initial setting that is a slight distance from the cylinder surface 45', a coarse grinding belt 21 is accelerated by means of a grinding belt drive 22, 23, 24 to a predetermined running velocity. In an pre grinding phase, the belt 21 is then pressed under a certain pressure to the outer surface 45' of the cylinder 45 to be processed in a manner such that the irregular cylinder surface 45' is uniformly removed. The uniform removal occurs independent of the surface geometry since a clearance $X1=X2=X/2$ is maintained between the profile plate 10 and the contact roll 23 by an adjusting device 30 as described in detail in the description relative to FIGS. 3 and 4. A pressure mechanism 43 such as a pneumatic cylinder, generates the clearance motion during grinding in the radial direction relative to the cylinder surface 45' of the contact roll 23.

The belt grinding apparatus 1 is axially displaced by a drive motor 14, 15 on the variable profile plate 10 in a manner such that the entire cylinder surface 45' is covered in overlapping grinding belt paths. As soon as the aforementioned surface layer has been ground off the cylinder surface 45', the conditions of the pressure acting on the grinding belt apparatus 1 are varied so that, in a subsequent contour grinding phase such as the precision grinding phase, a solid connection is established between the profile plate 10 and the contact roll 23. The connection is controlled by the variable feed slide 18 with the adjusting device 30, as already mentioned in the description relative to FIG. 3. The grinding belt apparatus 1 passes in a reciprocal motion in the axial direction over the entire length of the cylinder 45. After the grinding belt 21 becomes worn out, it is replaced and the feed slide 18 is adjusted accordingly. The passes are repeated until the cylinder 45 has attained the shape determined by the profile plate 10 in the axial direction along with the desired exact roundness. By the gradual uses of finer grinding belts 21, the grinding process is completed by a last grinding phase in which the exact and fine cylinder surface 45' required by the manufacturing process is obtained.

By means of the pre grinding phase wherein a clearance motion X occurs in accordance with the irregularities of the cylinder surface 45' by the grinding belt 21 as pressed by the contact roll 23 radially against said surface 45', uniform heating and thus uniform expansion in the radial direction of the cylinder surface is obtained. As compared to known processes, higher operating accuracies, shorter grinding time, less material removal, and extended life times of the cylinder 45 are attained. Also, grinding belts are saved.

The apparatus according to the invention is preferably used without oil, i.e. as a dry-grinding apparatus. However, it is readily possible to carry out known wet-grinding processes also.

What is claimed is:

1. An apparatus for grinding a cylindrical and spherical surface comprising:

a support, a profile plate adjustably mounted on said support, said profile plate having a profile that corresponds to a predetermined spherical surface profile, a grinding apparatus disposed on said support, said grinding apparatus having a grinding belt drive and a feed slide, said grinding belt drive having a contact roll, said feed slide having guide bushings for guiding said feed slide along said profile plate according to said surface profile, an adjusting device mounted on said feed slide for providing a radial clearance X between said profile plate and said contact roll during an initial grinding operation, a pressure mechanism mounted on said grinding apparatus for urging said adjusting device in the direction of the cylinder surface under a predetermined pressure during said initial grinding operation and for urging said adjusting device in an opposite direction during a subsequent grinding operation.

2. A grinding apparatus according to claim 1, wherein said adjusting device comprises a precision spindle supported in a bearing and a guide, said spindle having first and second stop rings disposed on opposite sides of said bearing, said spindle being movable within said guide so as to position said precision spindle such that there is at least a clearance between said first stop ring and said bearing and at least a clearance X' between said bearing and an inner frontal surface of said second stop ring.

3. An apparatus according to claim 2, wherein said clearance X is X/2 and said clearance X' is X'/2 and X/2 is substantially equal to X'/2.

4. An apparatus according to claim 2, wherein at least one of said first and second stop ring includes means for adjusting said at least one stop ring on said precision spindle.

5. An apparatus according to claim 1, wherein said pressure mechanism is pneumatic.

6. An apparatus according to claim 1, wherein said pressure mechanism is hydraulic.

7. An apparatus according to claim 1, wherein said support includes a thermal insulating plate for shielding said support against said cylinder surface.

* * * * *